US007040778B2

(12) United States Patent
Villarreal et al.

(10) Patent No.: US 7,040,778 B2
(45) **Date of Patent: *May 9, 2006**

(54) IMAGE UNLOCKING JEWELRY DEVICE

(76) Inventors: Jose I. Villarreal, 1807 Dulles, San Antonio, TX (US) 78251; Linda F. Villarreal, 1807 Dulles, San Antonio, TX (US) 78251

( * ) Notice: Subject to any disclaimer, the term of this patent is extended or adjusted under 35 U.S.C. 154(b) by 0 days.

This patent is subject to a terminal disclaimer.

(21) Appl. No.: 10/732,825

(22) Filed: Dec. 10, 2003

(65) Prior Publication Data

US 2005/0099797 A1 May 12, 2005

Related U.S. Application Data

(63) Continuation-in-part of application No. 10/056,897, filed on Jan. 25, 2002, now Pat. No. 6,715,911.

(51) Int. Cl.
*F21V 33/00* (2006.01)

(52) U.S. Cl. ..... 362/204; 362/806; 362/318; 63/29.1

(58) Field of Classification Search ..... 362/104, 362/276, 802, 318, 806; 315/76; 340/540; 250/214 AL, 239; 63/29.1; 40/725
See application file for complete search history.

(56) References Cited

U.S. PATENT DOCUMENTS

| | | | | |
|---|---|---|---|---|
| 4,920,672 | A | 5/1990 | Scott, Jr. et al. | |
| 4,973,835 | A * | 11/1990 | Kurosu et al. | 250/214 AL |
| 5,018,053 | A | 5/1991 | Belknap et al. | |
| 5,799,511 | A | 9/1998 | Benderly | |
| 6,238,084 | B1 | 5/2001 | Blotky et al. | |
| 6,304,520 | B1 * | 10/2001 | Watanabe | 368/203 |
| 6,340,868 | B1 * | 1/2002 | Lys et al. | 315/185 S |
| 6,527,610 | B1 * | 3/2003 | Hornsby et al. | 446/175 |
| 6,528,954 | B1 * | 3/2003 | Lys et al. | 315/291 |
| 2001/0038067 | A1 * | 11/2001 | Henoch | 250/221 |

FOREIGN PATENT DOCUMENTS

| | | |
|---|---|---|
| WO | WO 00/59327 | 10/2000 |

* cited by examiner

*Primary Examiner*—Thomas M. Sember
(74) *Attorney, Agent, or Firm*—Kammer Browning PLLC

(57) ABSTRACT

An image locking jewelry device designed to hide a customized image from view until the wearer reveals the image. The image unlocking jewelry device includes a lens mated to a casing and housing a liquid crystal display; a light emitting diode; circuitry placed inside the casing and capable of sending signals to the liquid crystal display and the light emitting diode; and an image positioned between the lens and the circuitry. Voltage is sent from the circuitry to the liquid crystal display and the light emitting diode in order to reveal the image held underneath the lens.

9 Claims, 2 Drawing Sheets

IMAGE UNLOCKING JEWELRY DEVICE

PRIOR APPLICATIONS

This application is a continuation-in-part of application Ser. No. 10/056,897 filed on Jan. 25, 2002 now U.S. Pat. No. 6,715,911.

TECHNICAL FIELD

The present invention relates generally to ornamental articles, and more particularly to articles of jewelry and method of making the same.

BACKGROUND OF THE INVENTION

Decorative items, namely jewelry, and its various constructions are well known in the art. Design, choice of materials and jewelry configuration have evolved primarily in response to technological advancements in relevant areas. In the past eleven years, significant advancement, such as laser technology, has occurred in the industry. Specifically, laser technology has added further aesthetic appeal by providing a variety of patterns on a substrate or in a layer that coats a substrate to evaporate to the required depth from selected regions and not from others. Examples of such devices and methods using this approach are found in the following U.S. Pat. Nos. 3,588,439; 3,832,948; 4,081,653; 4,156,124; 4,481,169; and 5,235,154. However, the use of such laser rays cause holes and burn marks on the substrate detracting from the aesthetic appeal of the engraved pattern itself.

Another advancement by the jewelry industry was the incorporation of images into its devices. An example of a device incorporating an image is depicted in U.S. Pat. No. 5,799,511 issued to Benderly on Sep. 1, 1998. The '511 patent is an article of jewelry having an annular support element and a disc-shaped sandwich mounted on the annular support element by being partially received in its groove. The sandwich includes a transparent protective element, a precious metal substrate carrying an image, namely a laser engraved image, and a bonding agent between the substrate and the element for improving the clarity of the image visible through the element. However, the '511 patent does not teach nor claim a process of uncovering the image through electromechanical, electromagnetic or proximate methods.

Another example of a jewelry article with integrated images is shown in U.S. Pat. Nos. 6,238,084 issued to Blotky et al. on May 29, 2001. The '084 patent claims a wristwatch having a time indicator disposed within a case; an electronic display attached to the case arranged for visibility when worn by a user; a controller disposed in the case and adapted to generate signals for the electronic display; and a bezel containing a removable memory. However, the '084 patent fails to incorporate a jewelry device being in communication with a companion device.

Similar to the '084 patent, International Patent 00/59327 claims a bracelet having an annular body with an outer surface. The outer surface includes a display area defined by an active display element for selectively displaying images. The display can be formed by a display layer made of a light emitting polymer or interconnected links formed with LCD elements. Further, a display control circuit is disposed within the annular body and generates signals defining the images for the display element. Nevertheless, the '59357 patent does not provide for a method of revealing an image through electromechanical, electromagnetic or proximate processes.

In view of the above described deficiencies associated with the use of conventionally designed jewelry, the present invention has been developed to alleviate these drawbacks and provide further benefits to a user. These enhancements and benefits are described in greater detail herein below with respect to several alternative embodiments of the present invention.

SUMMARY OF THE INVENTION

The present invention in its several disclosed embodiments alleviates the drawbacks described above with respect to jewelry devices and incorporates several additionally beneficial features. The present invention described herein a jewelry device designed to hide and reveal an image positioned therein. The image may be predetermined or preferably customized by a manufacturer, seller and/or buyer of the device. Specifically, the image is inserted between a lens and a casing which may be mated to a jewelry attachment. A layer of liquid crystal having a cover set thereon is contained inside a lens and mounted over the image and is designed to transition from one shade to another based on the application of voltage. The voltage, including a transceiver and a battery, is generated from circuitry disposed within the casing.

In one embodiment, the casing includes a plurality of buttons capable of being depressed. When a button is depressed, a voltage from the circuitry is sent to the liquid crystal display where the display transitions from a secure opaque color to a clear color thereby revealing the image held underneath the display. In an alternative embodiment, when a button is pressed, a signal is sent from the jewelry device to a companion device thereby displaying the image held within the companion device.

In another embodiment, the jewelry device electromagnetically communicates with the companion device. Specifically, the jewelry device generates and sends a magnetic resonant frequency to the companion device to reveal the image held therein. In turn, the jewelry device may receive signals sent from the companion device; and as a result, the image within the jewelry device is uncovered.

In still another embodiment, at least one light emitting diode (LED) is incorporated inside the casing in a position suitable for illuminating the image underneath the LCD. The circuitry of the device includes circuitry to drive the LED in conjunction with the process of clearing the LCD to reveal the image.

It is therefore a goal of the present invention to provide an image unlocking jewelry device capable of revealing and concealing a picture from the general public's view. The picture may be customized by the purchaser or user; or alternatively may be a predetermined image chosen by the seller or manufacturer based on popularity in order to generate revenue. Preferably, the customized image is a keepsake memento or a security image/password stored within the jewelry device.

Another advantage of the present invention is to provide for an adaptable liquid crystal display having the ability to change from one color to another or from an opaque shade to a clear shade.

Another benefit of the present invention is to provide an aesthetically appealing and adaptable jewelry device. Specifically, the jewelry device is capable of being mounted onto several different jewelry attachments each having a different configuration. Further, the jewelry device is easy to manufacture and may be utilized for both personal and commercial uses.

Further advantages of the invention will be more clearly understood from the following description of illustrative embodiments thereof, to be read by way of example and not of limitation in conjunction with the apparatus and method shown. The beneficial effects described above apply generally to the exemplary devices disclosed herein of the image locking jewelry device. The specific structures through which these benefits are delivered will be described in detail herein below.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention. Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
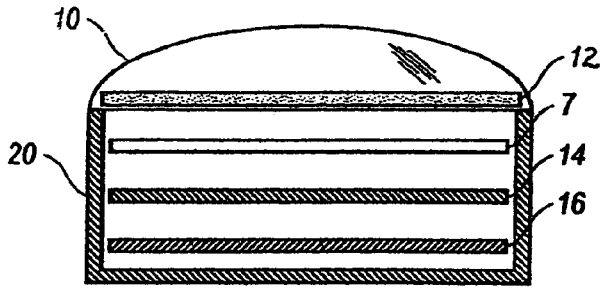
FIG. 1 is cross-sectional view of an image locking jewelry device having an image placed underneath a piece of magnifying glass.
Figure 2:
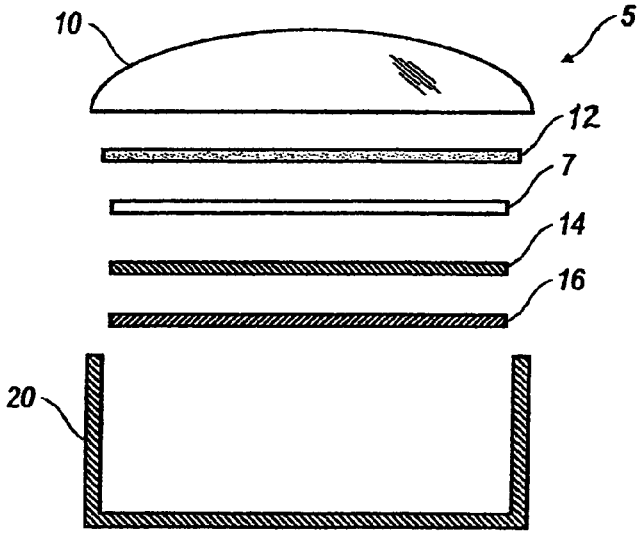
FIG. 2 is an exploded view of the present invention according to the embodiment shown in FIG. 1.

FIGS. 1 and 2 illustrate a jewelry device 5, namely an image locking jewelry device, designed to conceal an image from view until made available by a wearer. The jewelry device 5 collectively includes a lens 10 coupled to a casing 20, preferably made of metal, having a base and a vertical periphery extending from the base and surrounding a cavity 22 formed therein. Preferably, the lens 10 is a magnifying piece of glass or mirror cover and is capable of having color injected therein in order to add more aesthetic appeal. In an alternative embodiment, the lens 10 may be made of scratch-resistant material in order to prolong the aesthetic life of the jewelry device 5.

A liquid crystal display (LCD) 12 has at least one layer of liquid crystals and a cover and is operatively inserted within and enclosed by the lens 10, preferably located at a bottom portion of the lens 10. The liquid crystals are made of, but not limited to, thermotropic liquid crystals, isotropic liquid crystals, nematic liquid crystals, super twisted nematics, dual scan twisted nematics, ferroelectric liquid crystals or surface stabilized ferroelectric liquid crystals. Here, the LCD 12 is capable of transitioning from an opaque color to a clear shade, or alternatively may depict colors, when a voltage is applied thereto. Operatively speaking, when the electric charge is applied to the liquid crystal molecules, they straighten out and change the angle of the light passing through them which no longer matches the angle of a top polarizing filter. As a result, no light can pass through that area of the LCD 12, thus making that area darker.

Preferably, the LCD 12 will have at least three subpixels with color filters, namely blue, red, and green, to create each color pixel. When voltage is applied, the resulting intensity will range over 256 shades for each subpixel. However, the amount of pixels may be increased in order to enlarge display size of the jewelry device 5.

The LCD 12 may be either common-plane, passive matrix or an active matrix LCD. Preferably, the LCD 12 is an active matrix LCD being dependent on thin film transistors arranged in a matrix on a glass substrate. Here, a row is switched on and a charge is sent down a column in order to address a particular pixel. A capacitor at the designated pixel receives a charge and is capable of holding the charge until the next cycle. Operatively speaking, when the amount of voltage supplied to a crystal is controlled, the LCD 12 can create a gray scale.

An image 7 is positioned underneath the lens 10 and is preferably customized according to a wearer's taste. The image 7 may be a security password stored within the device 5 for security purposes. In a preferred embodiment, the wearer or another person supplies the image 7 to a jeweler; and the jeweler scans the image 7 into a computer and prints the image 7 onto photographic paper. Thereafter, the image 7 is punched out and is placed with the jewelry device 5 adjacent to the lens 10. Alternatively, a manufacturer may utilize a predetermined image 7 to be mass produced inside such jewelry device 5.

A transceiver 14 and various circuitries are disposed between the image 7 and a battery 16 being adjacently positioned on top of the casing 20. The casing 20 may incorporate a series of small buttons 25 attached thereto and capable of being depressed. The button-press is detected by the circuitry sending a voltage to uncover the image 7 for a predetermined amount of time.

In a preferred embodiment, the various circuitries may include a light emitting diode (as described in more detail below), a sensor and a printed circuit board, namely made from fiberglass, containing battery contacts, and the necessary electronics.

Figure 4:
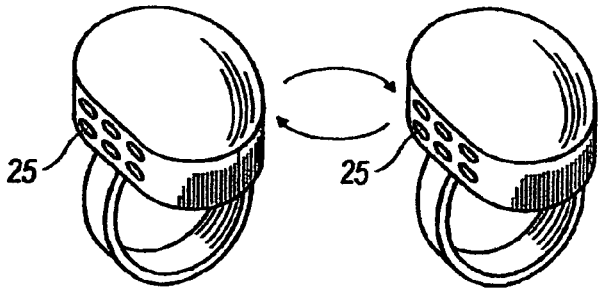
FIG. 4 is a schematic view of the present invention being in communication with a companion device.

The button-press is detected by the circuitry and is translated into a sequence. In the most preferred embodiment, each button has a different sequence programmed therein. The circuitry sends a signal, such as an infrared signal, out to a transistor to amplify and strengthen the signal. In turn, the transistor sends the signal to the light-emitting diode and a sensor incorporated in a companion apparatus of the jewelry device 5 will react accordingly. Likewise, the sensor of the jewelry device 5 will read and react to a signal being sent from the companion device as shown in FIG. 4.

In an alternative embodiment, the jewelry device 5 is capable of electromagnetically communicating with its companion device. The companion device is configured substantially similar to the jewelry device 5 itself. When the circuitry electrically communicates with the battery 16 or other power source, the battery 16 will produce electrons which collect at a negative end and flow to a positive end and a small magnetic field is generated within the circuitry. The generated magnetic field may be amplified by coiling the circuitry, specifically the wiring within the circuitry. As a result, a magnetic resonant frequency is sensed from the companion device and a signal is sent to the companion device to reveal the image held therein. Preferably, the proximate distance is half a meter or less in order to reduce the amount of resulting voltage being required.

The frequency sensed by either the jewelry device or companion device may be established for a coupled set or expanded to be utilized by a group. The resulting frequency may be customized in order to verify membership, permission or authority of use from one device 5 to another. In particular, the frequency may all be set to the same frequency or alternately each frequency setting may be individualized.

Figure 3:
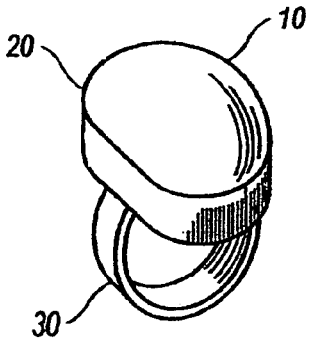
FIG. 3 is an isometric view of the present invention mounted onto a jewelry attachment.

In FIG. 3, the casing 20 of the jewelry device 5 is mounted onto a jewelry attachment 30. The jewelry attachment 30 may be in the form of a necklace loop, an annular configuration, a wrist band, an earring fastener, pen adornment or other fastening mechanism and may be made of any lightweight wearable material. The jewelry device 5 and its companion device may be connected to the same jewelry attachment 30 or may be mounted onto different jewelry attachments 30.

Figure 5:
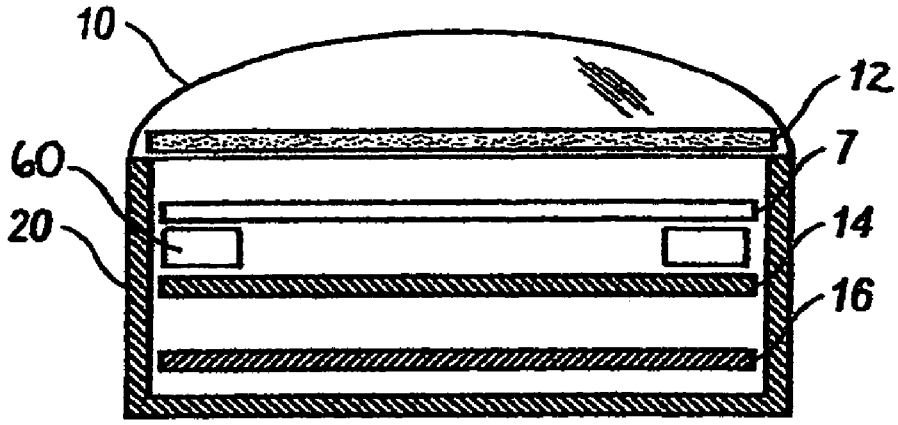
FIG. 5 is cross-sectional view of an alternate embodiment of the image locking jewelry device of the present invention.
Figure 6:
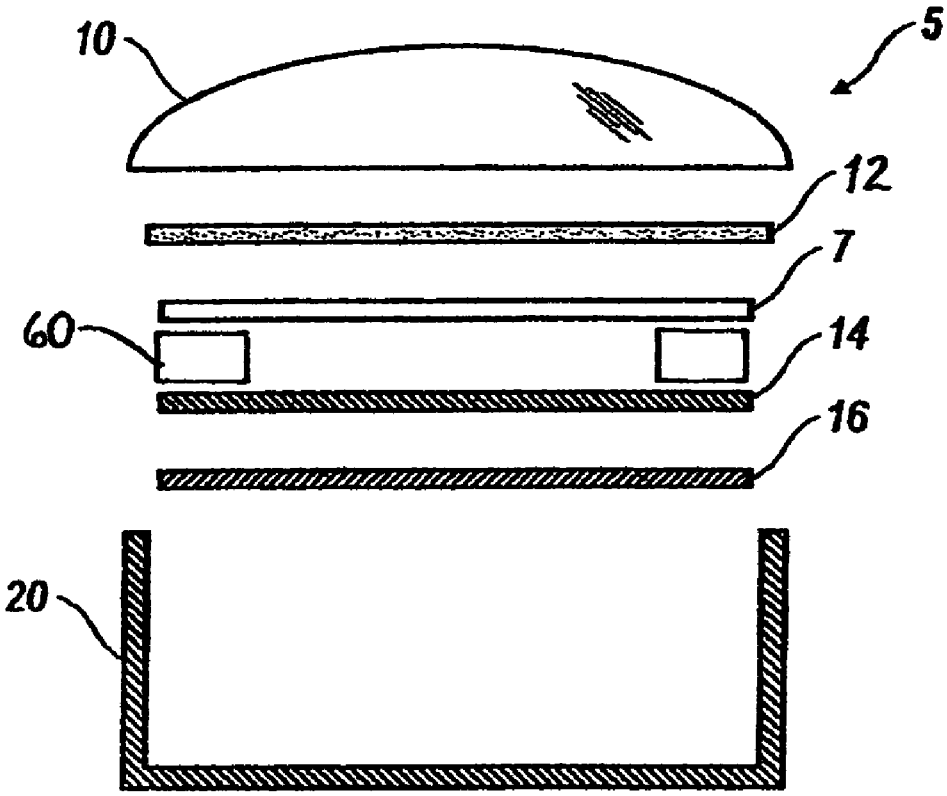
FIG. 6 is an exploded view of the present invention according to the embodiment shown in FIG. 5.

FIGS. 5 and 6 disclose the alternate preferred embodiment mentioned above that includes one or more light emitting diodes (LEDs). 60 positioned within casing 20. In this embodiment, LEDs 60 are positioned to illuminate image 7 simultaneously with the process of electronically "clearing" LCD 12. Because image 7 is typically printed on photographic paper (as indicated above), and is therefore typically partially translucent, LEDs may be positioned to illuminate image 7 from above (to the side) or from below.

INDUSTRIAL APPLICABILITY

The present invention finds specific industrial applicability in the jewelry and security industries.

What is claimed and desired to be secured by Letters Patent is as follows:

1. An image unlocking jewelry device comprising:

a casing having a base and a periphery upwardly extending from said base forming an interior cavity;

a lens mated to said casing and housing a liquid crystal display therein, said liquid crystal display operable to alternate between a transparent state and an opaque state;

at least one light emitting diode positioned within said casing;

circuitry disposed within said casing and electrically sending signals to said light emitting diode and said liquid crystal display; and an image mounted between said lens and said circuitry and adjacent said at least one light emitting diode.

2. The image unlocking jewelry device as recited in claim 1, wherein said casing is made of metal.

3. The image unlocking jewelry device as recited in claim 1, wherein said lens is made of material selected from the group consisting of a magnifying piece of glass, a mirror cover and a scratch-resistant material.

4. The image unlocking jewelry device as recited in claim 1, further comprising a transceiver disposed within said casing and sandwiched between said image and a battery.

5. The image unlocking jewelry device as recited in claim 1, wherein said casing has a plurality of buttons capable of being depressed and being detected by said circuitry.

6. The image unlocking jewelry device as recited in claim 5, wherein each of said plurality of buttons is capable of having a different sequence programmed therein.

7. The image unlocking jewelry device as recited in claim 1, wherein said jewelry device sends a signal to at least one companion device.

8. The image unlocking jewelry device as recited in claim 1, wherein said image has a security password.

9. The image unlocking jewelry device as recited in claim 1, wherein said jewelry device is coupled to a jewelry attachment selected from a group consisting of a necklace loop, a ring, a wrist band, an earring fastener and a pen adornment.

* * * * *